US005634508A

United States Patent [19]

Herbst

[11] Patent Number: 5,634,508

[45] Date of Patent: Jun. 3, 1997

[54] MOLDED DOOR

[76] Inventor: Walter B. Herbst, 1875 N. Pond La., Lake Forest, Ill. 60045

[21] Appl. No.: 480,693

[22] Filed: Jun. 7, 1995

[51] Int. Cl.[6] ..... A47H 3/00

[52] U.S. Cl. ..... 160/371; 160/369; 160/380; 52/656.4; 52/784.1; 52/792.11; 49/503

[58] Field of Search ..... 160/369, 371, 160/380; 49/501, 502, 503; 52/784.1, 784.12, 784.13, 784.15, 792.1, 792.11, 455, 314, 316, 656.4

[56] References Cited

U.S. PATENT DOCUMENTS

| | | | |
|---|---|---|---|
| 1,800,800 | 4/1931 | Kerby | 160/380 |
| 3,878,649 | 4/1975 | Mennuto | 49/501 |
| 4,311,183 | 1/1982 | Herbst et al. | 49/501 X |
| 4,327,535 | 5/1982 | Governale | 49/501 X |
| 4,589,240 | 5/1986 | Kendall et al. | 52/784.13 X |
| 4,922,674 | 5/1990 | Thorn | 52/784.13 X |
| 5,161,346 | 11/1992 | Olson et al. | 49/501 X |
| 5,448,872 | 9/1995 | Thompson et al. | 52/784.13 |

*Primary Examiner*—Blair Johnson
*Assistant Examiner*—Bruce A. Lev
*Attorney, Agent, or Firm*—Jack E. Dominik

[57] ABSTRACT

A sheet molded compound (SMC) which is a fiberglass reinforced composite material, produced in a sheet format, for forming a door, is disclosed. The material includes strands of oriented chopped fiberglass in combination with a resin, filler paste, and desirably an inert material such as talc in concentrations to and including up to approximately 40% of the composition. The SMC is subjected to matched molding, male and female, into a configuration in which one-half includes the window recess, a track for the same, the track being conformed by virtue of an offset for a screen as well. The entire door, is subsequently filled with foam to secure the two halves together. A closer recess, pocket for a lock, and screen and window mounting means are also disclosed.

10 Claims, 9 Drawing Sheets

MOLDED DOOR

FIELD OF THE INVENTION

The present invention relates primarily to storm doors which are molded of two halves. Exemplary is U.S. Pat. No. 4,311,183.

SUMMARY OF THE PRIOR ART

The present invention, as set forth above is related to the combination storm and screen self-storing door disclosed in U.S. Pat. No. 4,311,183. The present inventor is one of the joint inventors in that patent. A careful examination of U.S. Pat. No. 4,311,183 will show that thermal expansion and contraction plagues any two-piece molded door. This is specifically illustrated in FIGS. 17 and 18 of U.S. Pat. No. 4,311,183. To combat this phenomenon of thermal expansion and contraction, a steel beam as identified in FIG. 16 of U.S. Pat. No. 4,311,183 was required. Additionally, reinforcing bars were required elsewhere throughout the door. This increases the manufacturing cost. Additionally spacers were required in the construction of U.S. Pat. No. 4,311,183 to allow for a separate track for the screen and window.

In addition the door of U.S. Pat. No. 4,311,183 was predicated upon screwing the two halves together by the overlapping lateral flanges and having one of the flanges pre-drilled with a slot rather than a hole thus allowing one-half to slide over the other as a result of expansion and contraction. This increased the manufacturing cost by the labor of screwing in place and in addition the cost of the screws themselves.

By way of improvement, what is highly desirable in a combination storm and screen door, or indeed just a storm door, is one which is thermally stable and achieves such stability without the use of special reinforcement. Another desirable quality in a door is one in which the two halves can be press-fittingly secured together in the manufacturing process which significantly reduce costs in that process, and by eliminating screws and reinforcing members, as well as screen and window spacers, eliminates various areas of vulnerability to loss of various fastening members and degradation of the structural integrity of the door. Another method of joining the two halves together and at the same time increasing structural stability is the assembly of the two halves using an expanding foam material. This results in "gluing" the halves together. To allow for storage and movement of the window and screen on the interior of the door, the two halves may have the foam on the interior periphery only.

SUMMARY OF THE INVENTION

The present invention evolves, in part, from the awareness of a sheet molded compound (SMC) which is a fiberglass reinforced composite material, produced in a sheet format. The material includes strands of oriented chopped fiberglass in combination with a resin, filler paste, and desirably an inert material such as talc in concentrations to and including up to approximately 40% of the composition. The SMC is subjected to matched molding, male and female, into a configuration in which one-half includes the window recess, a track for the same, the track being conformed by virtue of an offset for a screen as well, and optionally a plurality of fastening bosses on each half (the outside half and the inside half) of the door which are optionally held together by using a zero-like tolerance and opposed tapers on male and female opposed bosses such as cups and plugs. Optionally, the plugs and cups may be employed, and a dam assembly positioned around the periphery of the entire door, and subsequently filled with foam to secure the two halves together. In many applications the cups and bosses will not be needed, and dammed in foamed area will not only secure the two halves together, but actually adhere to the inner and outer halves. To further insure the dimensional stability, a plurality of essentially uniform trusses may be provided along the lateral edges of the two sides of the door, and the bosses are staggered between the window opening side of the opening and the door edge side to further enhance stability. Additionally means are provided in the door for a torsional spring door closer, a mortised pocket for a door mortised lock set insertion, and a single track for separating and slidably mounting a window and a screen to pre-selectively overlie the window opening area. Also provision is made for a spring dampener assembly for an automatic closer and damper, the recess being applied adjacent all four corners or the middle to receive the cartridge containing the closer and damper. The provision for mortised pocket is supplied at the left-hand side and the right-hand side so that with regard to the lock and to the closers, the door is automatically left-hand/right-hand.

In view of the foregoing it is a principle object of the present invention to provide a molded door of sheet molded composition material which is dimensionally stable, eliminates interior metallic reinforcements, and yet accommodate a self-storing window and screen combination.

A related and most important object of the present invention is to provide a molded door of two halves in which the two halves can be foamed together for a glue-like secured relationship by the action of the foam engaging the interior skin of the door.

Yet a further object of the present invention is to provide a door of two molded halves which are snap-fittingly engaged each to the other with interior structural trusses which augment the strength characteristic of the door.

Yet another and most important object of the present invention is to provide a door molded of two halves which are snap-fittingly engaged to each other, without metallic interior trusses, which is cost wise competitive with the prior art.

BRIEF DESCRIPTION OF THE ILLUSTRATIVE DRAWINGS

The foregoing objects and advantages of the present invention will be more fully understood as the following description of an illustrative embodiment takes place, taken in conjunction with the accompanying drawings, in which.

Figure 12:
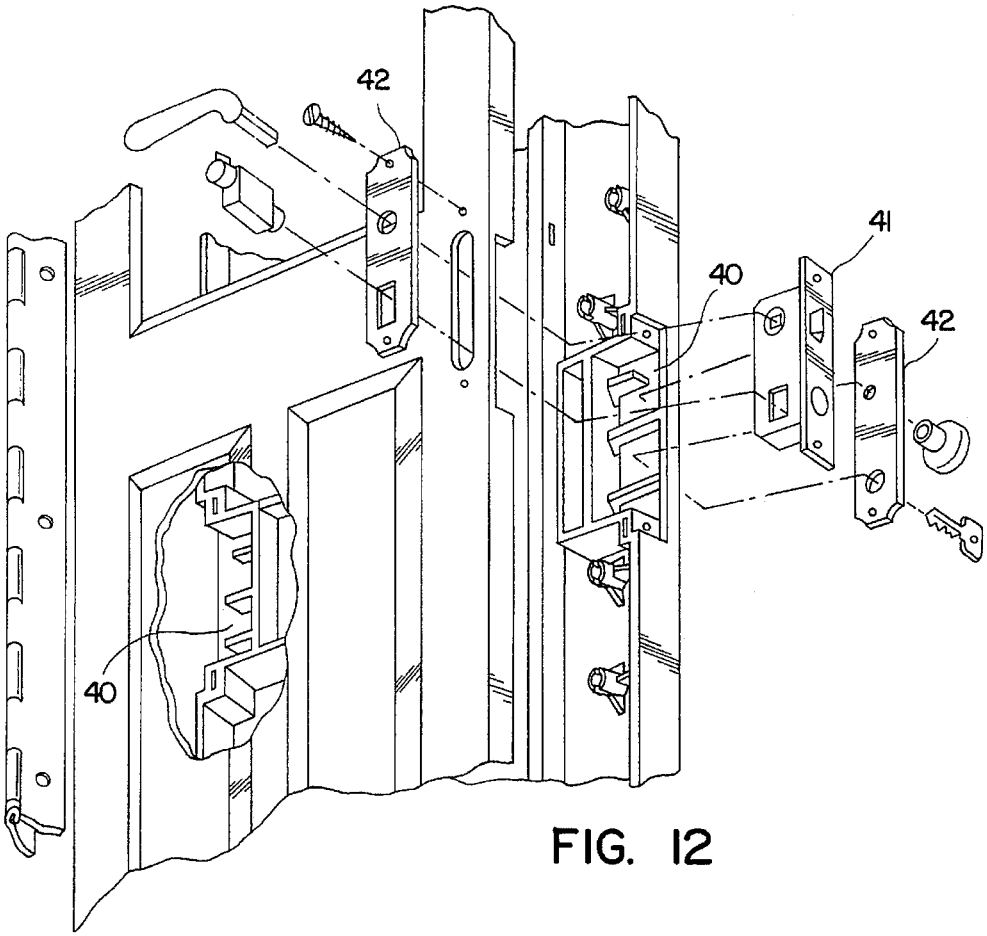
Figure 13:
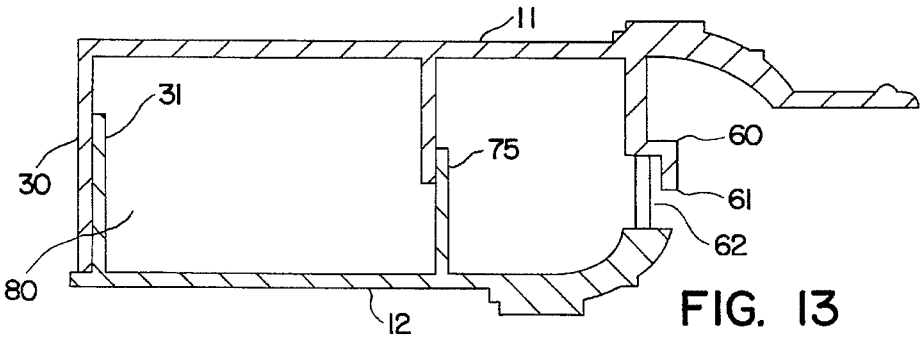
Figure 14:
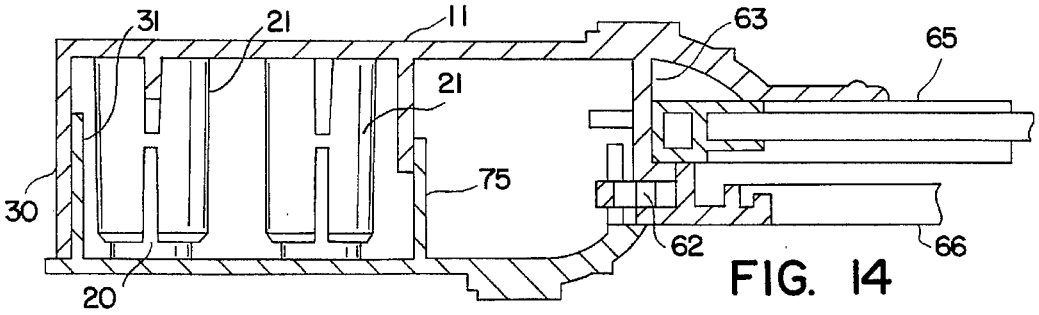
Figure 15:
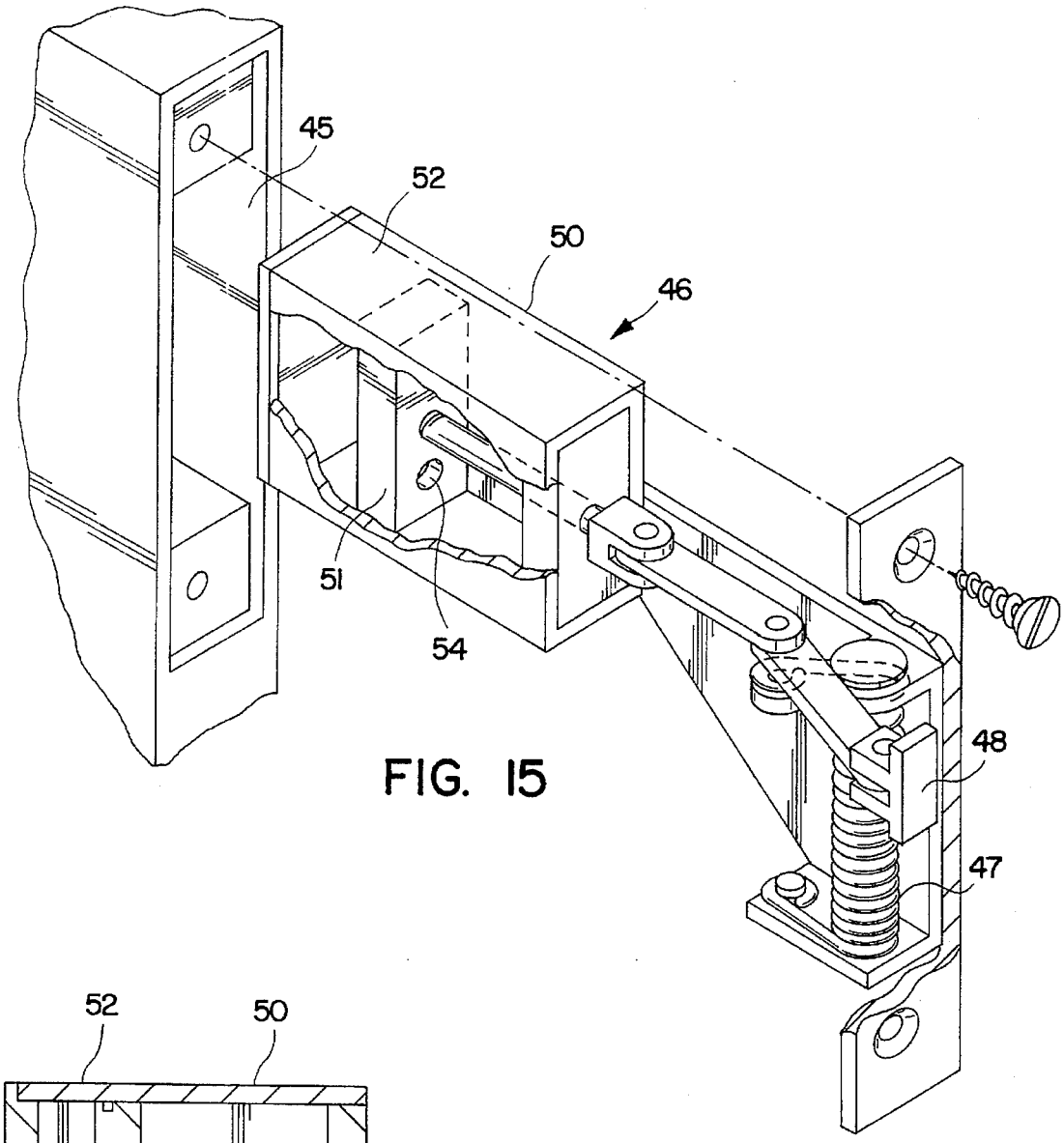
Figure 16:
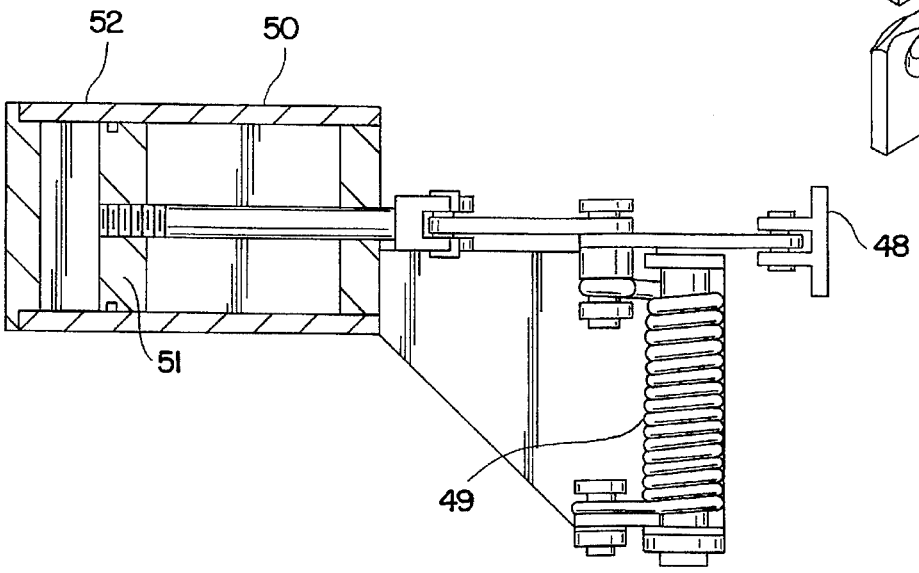
Figure 17:
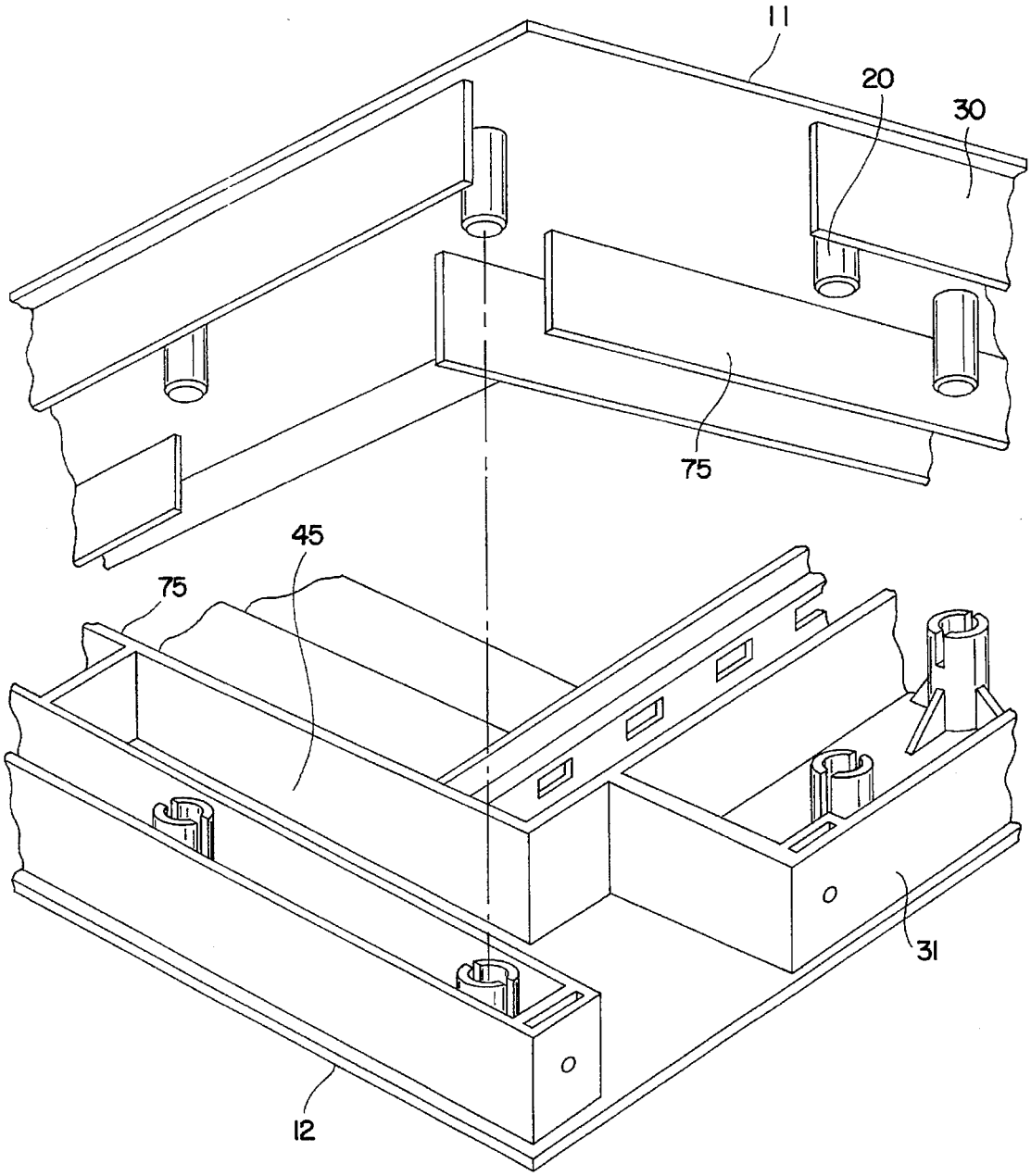
Figure 18:
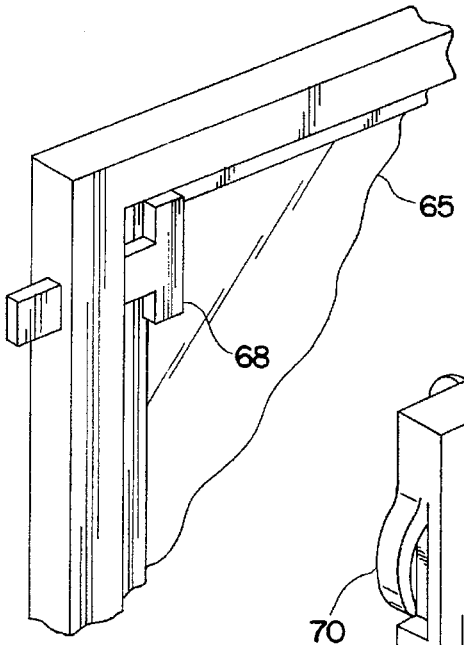
Figure 19:
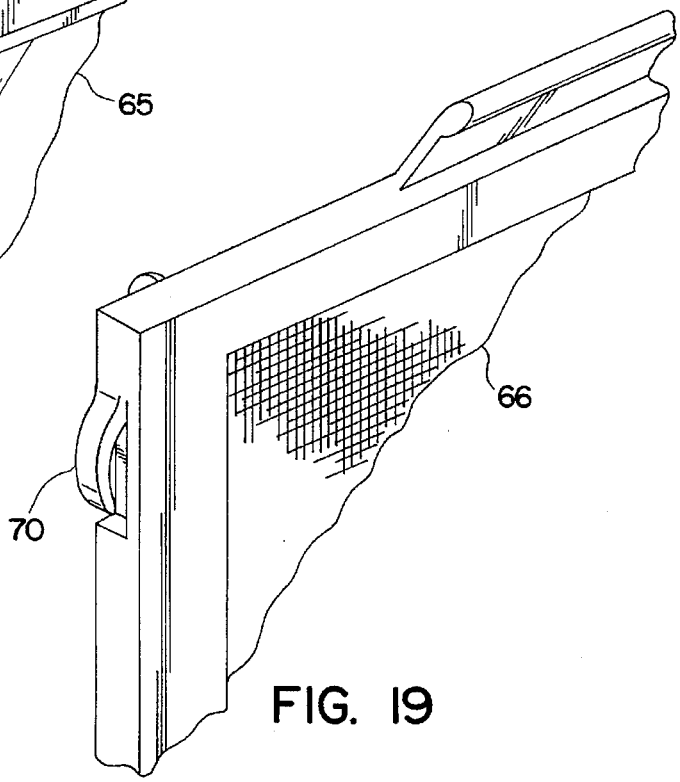

FIGS. 8, 9, 10, and 11 are enlarged partially broken sectional views of the periphery of the door frame showing the relationship between the plugs and cups;

FIG. 12 is an exploded perspective view of the recessed mortise lock;

FIG. 13 is a further sectional view of the peripheral portion of the door showing the foam partially in place as confined by the inner dam;

FIG. 14 is an alternative view showing the plugs in place and also the foam in between the halves of the door;

FIG. 15 is a perspective view of the door closer and dampener;

FIG. 16 is a front elevation partially broken of the closer and dampener of FIG. 15;

FIG. 17 is an enlarged exploded perspective view of a corner portion of the door showing the recess for the door closer and the relationship between the dam elements and the optional frictional secured members;

FIG. 18 is a broken corner view of the storm window;

FIG. 19 is a broken perspective corner view of the spring; and

Figure 20:
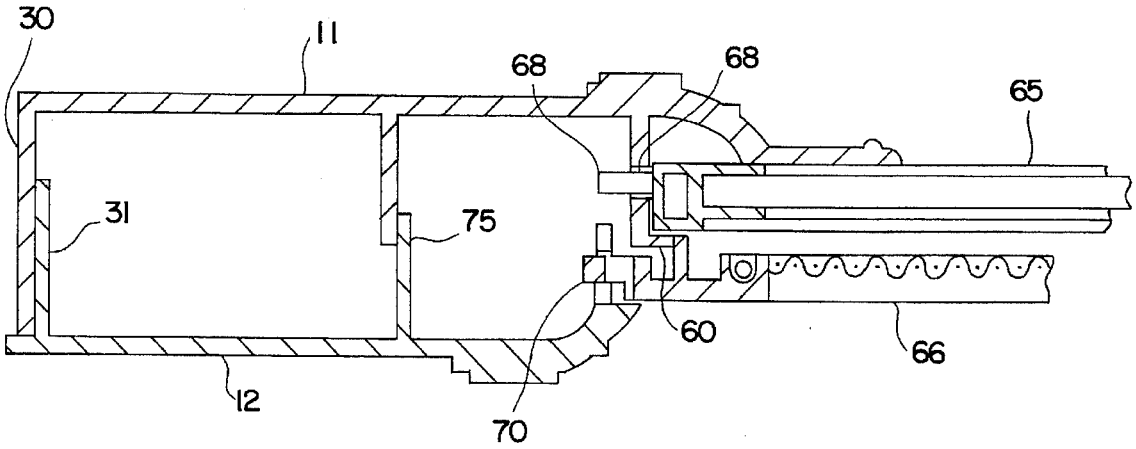

FIG. 20 is a sectional view taken at the upper portion of the frame portion surrounding the window illustrating the track which separates the storm window latch from the screen latch and their cooperative relationship.

DESCRIPTION OF THE EMBODIMENT

Figure 2:
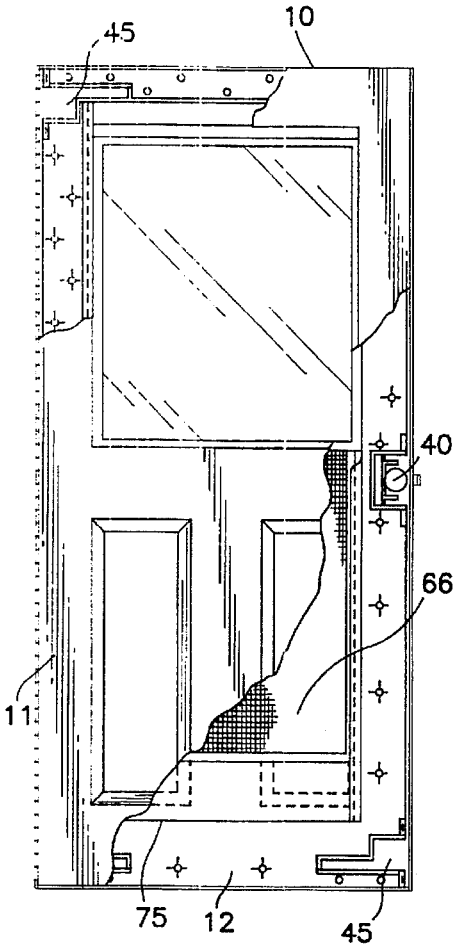
FIG. 2 is a partially broken view showing the door of FIG. 1 in reduced scale, and revealing the location of the screen and storm window.
Figure 1:
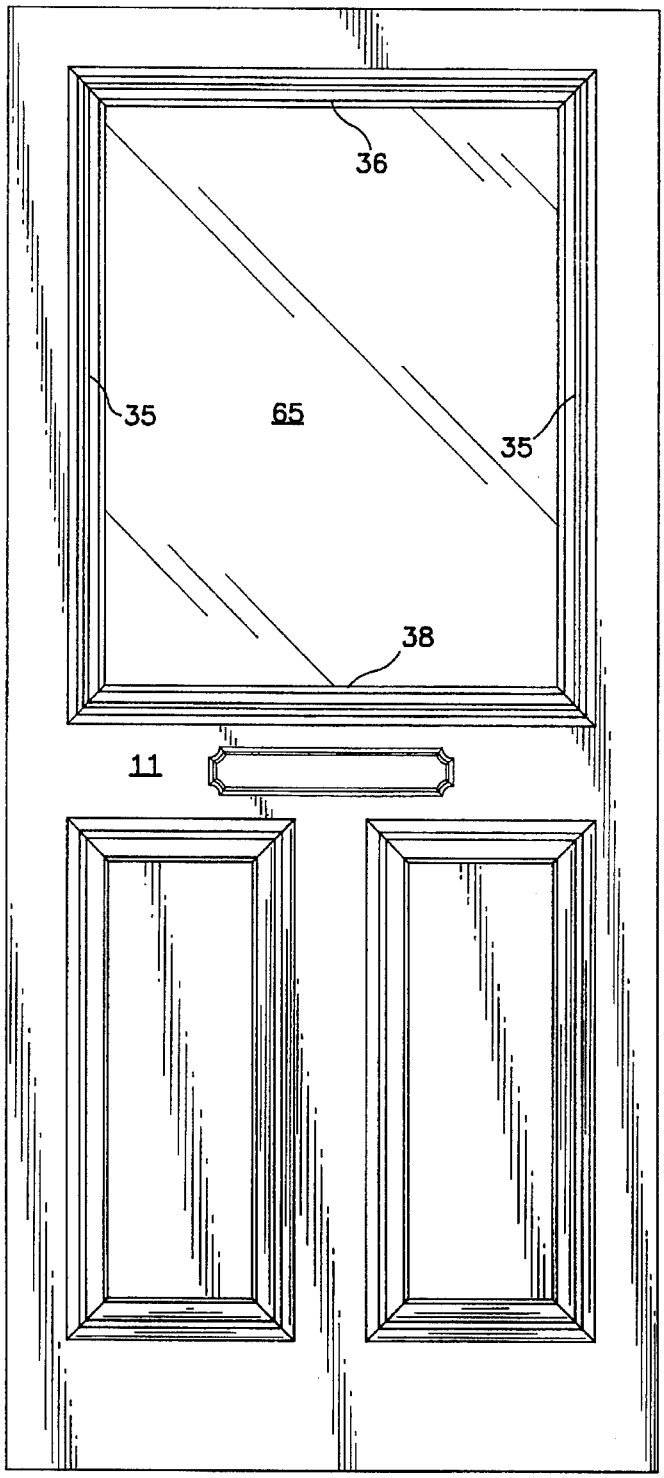
FIG. 1 is a front elevation of the outside of the subject door showing the window in place.
Figure 4:
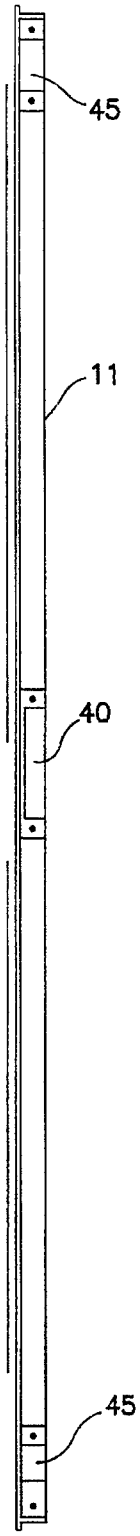
FIG. 4 is a side elevation of the outer half of the door as shown in FIG. 3 and in the same scale.
Figure 3:
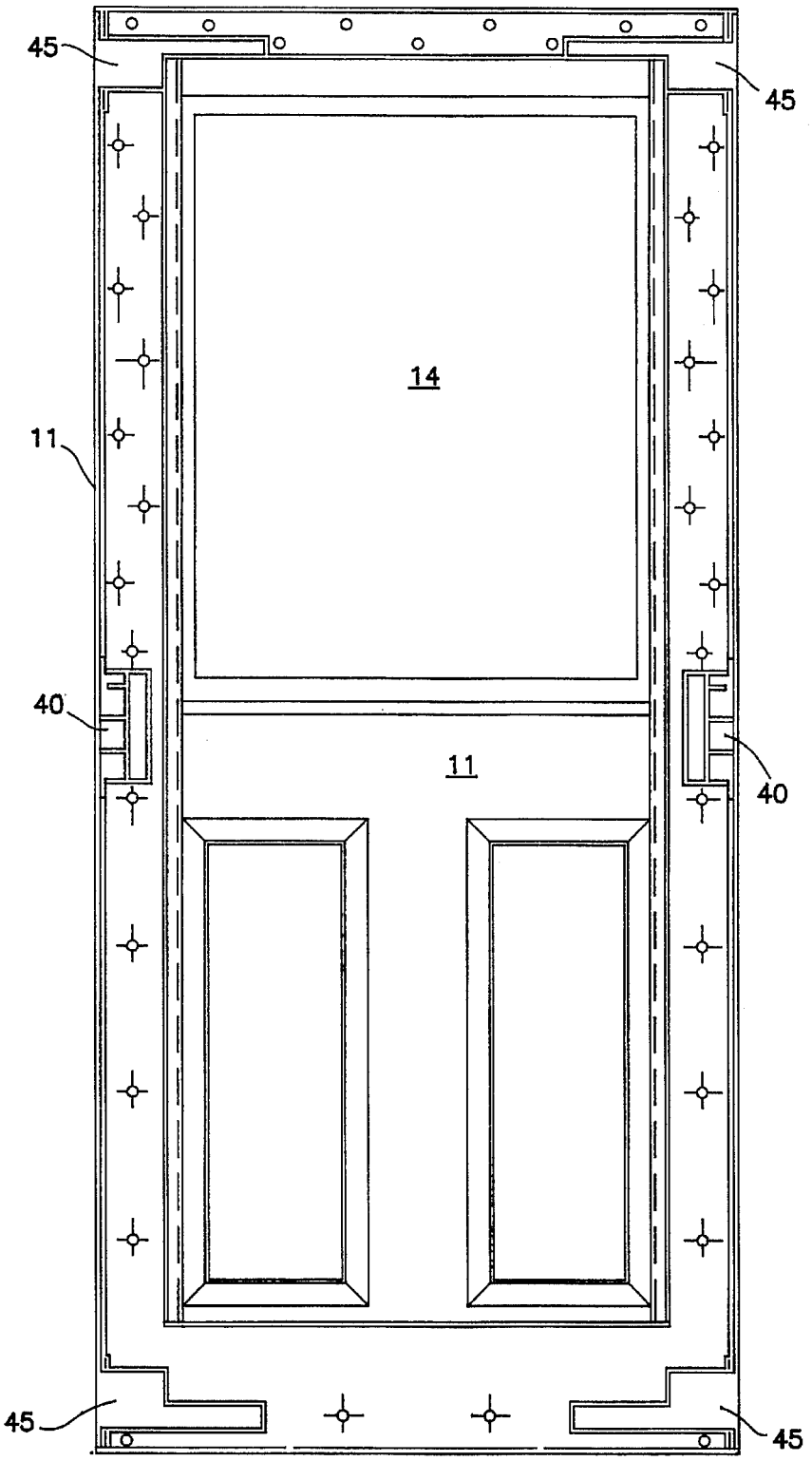
FIG. 3 is a planar view of the inside of the outer half of the door.
Figure 5:
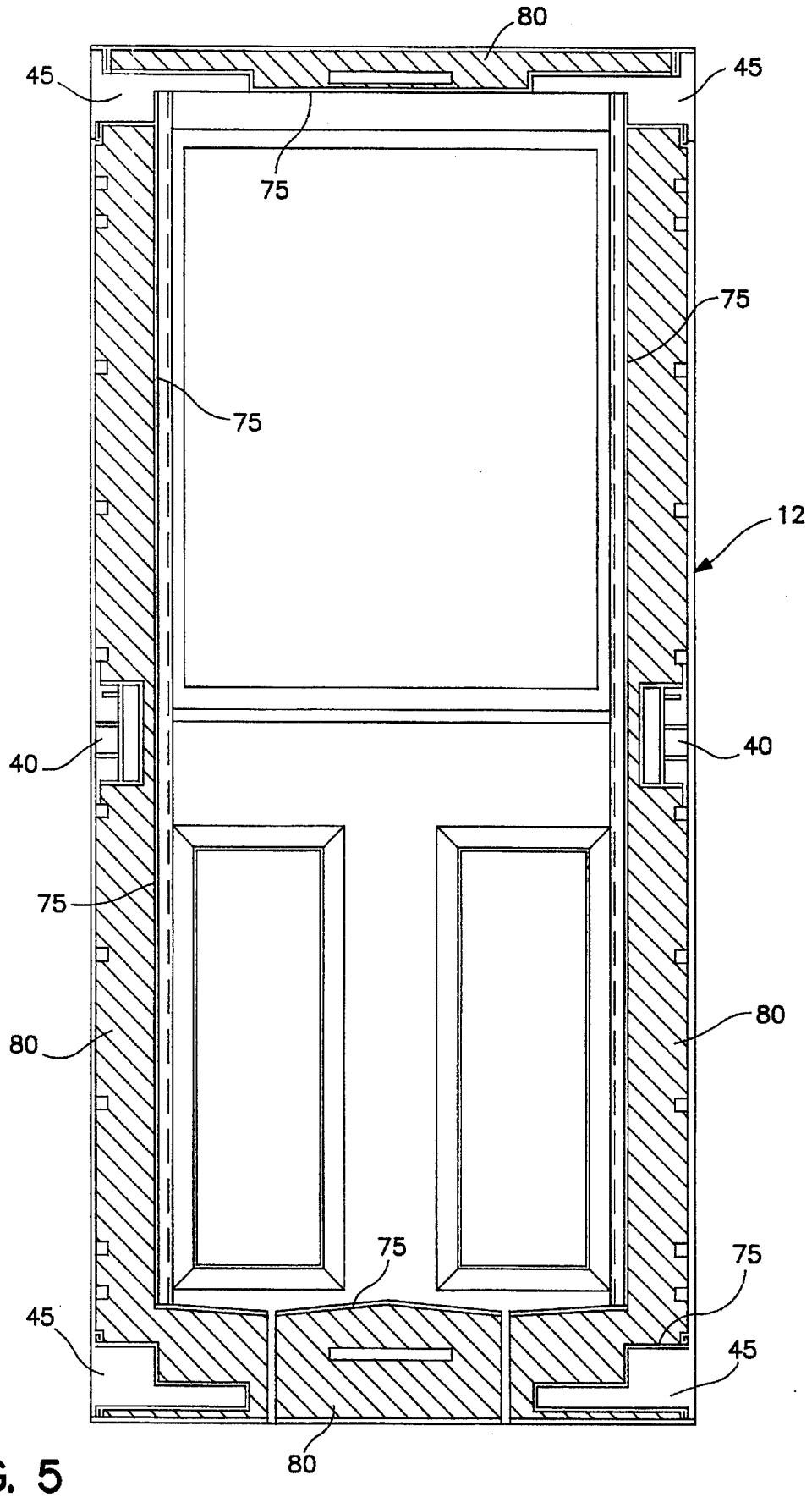
FIG. 5 is a planar view of the inside of the inner half of the door showing the foamed area and its surrounding dam portions.
Figure 7:
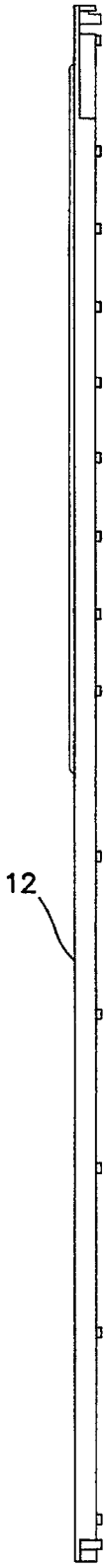
FIG. 7 is a side elevation of the front half of the door as shown in FIG. 6 and in the same scale.
Figure 6:
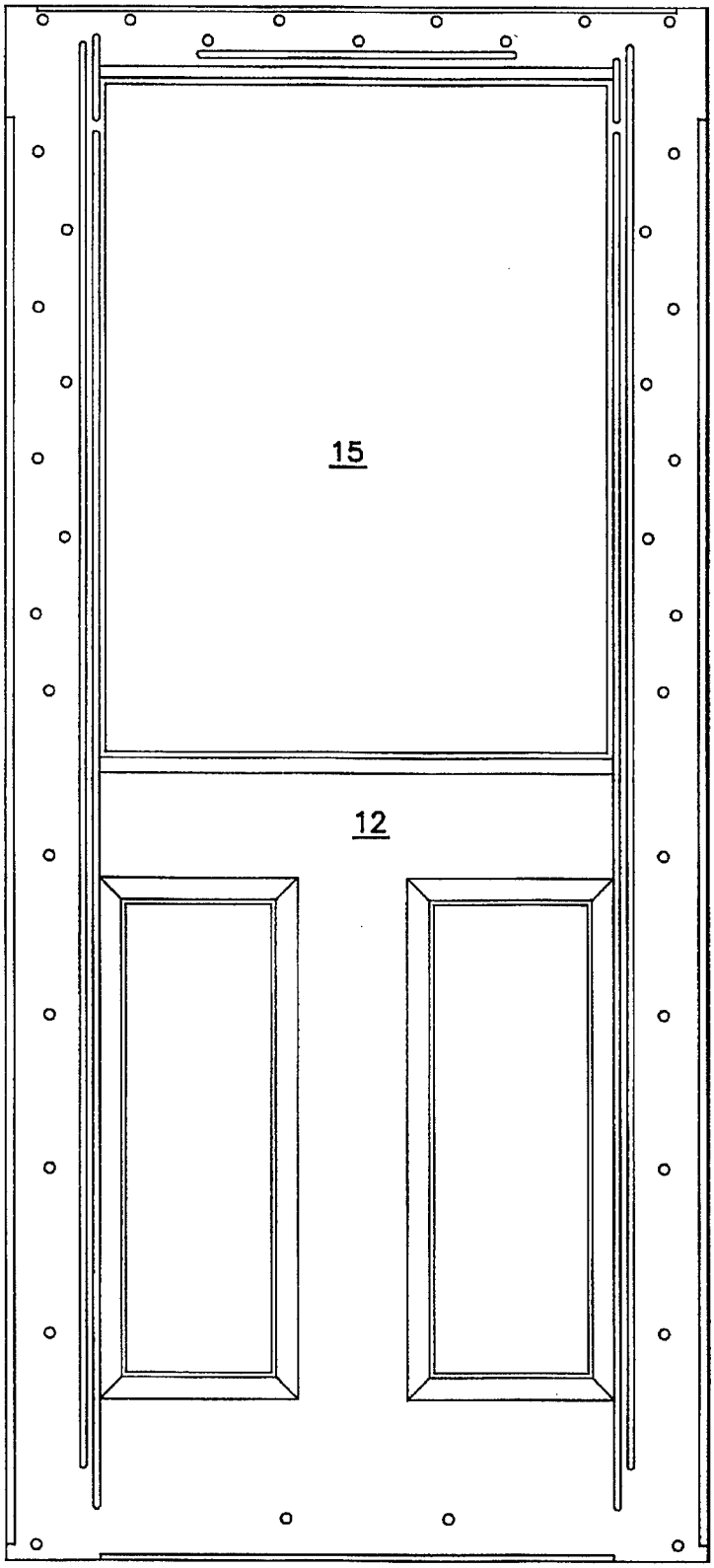
FIG. 6 is a front elevation of the inside of the outer half of the door showing the location of the press-fitting interfit assembly.

The present invention is illustrated in FIGS. 1 and 2 where it will be seen that the storm door 10, includes an outer half 11 and an inner half 12. The outer half of the storm door has a window opening 14, and the inner half of the storm door has a window opening 15.

The present invention is made possible by the utilization of a sheet molding compound, hereinafter referred as SMC, which is a fiberglass-reinforced composite material. The material is produced in a sheet format. The process for producing the material begins when a continuous strand of fiberglass is chopped into desirable lengths, usually under two inches. The strands are deposited onto a bottom layer of paste made from resin and filler. A top layer of resin and filler paste sandwiches the fibers to the bottom layer of paste, and it is covered by another carrier film. The paste-and-fiber sandwich is then compacted by a series of rollers to make a continuous sheet of molding compound (SMC). The SMC may be produced by anyone skilled in the art. While no claim is made here to the invention of the SMC, the adaptation of the SMC to compression mold a two-piece storm door from a thermoset material is claimed as novel with the applicant and a new use for a pre-existing material. The material is formed by match molding at a temperature of 300° to 400° and a pressure of one thousand pounds. The match molds are formed to produce the configuration as set forth hereinafter.

Figure 8:
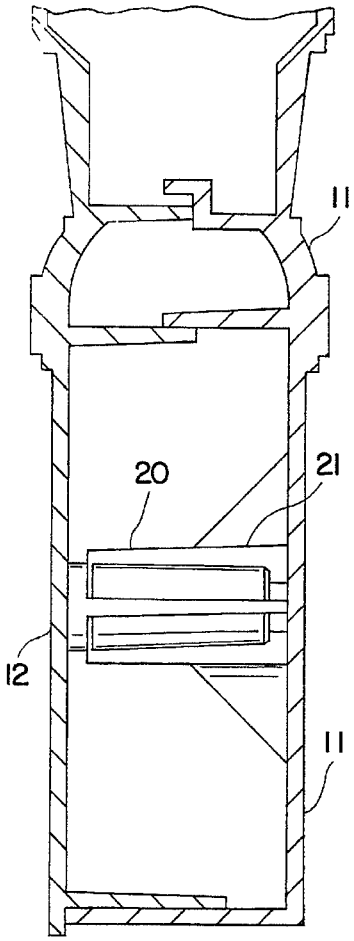
Figure 9:
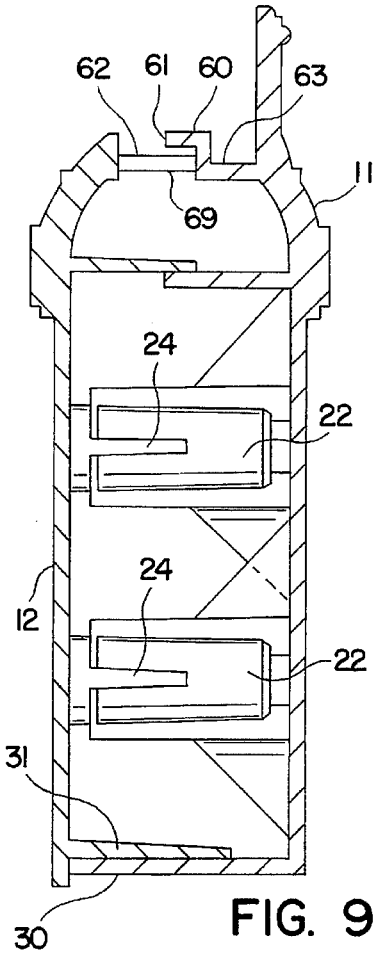
Figure 10:
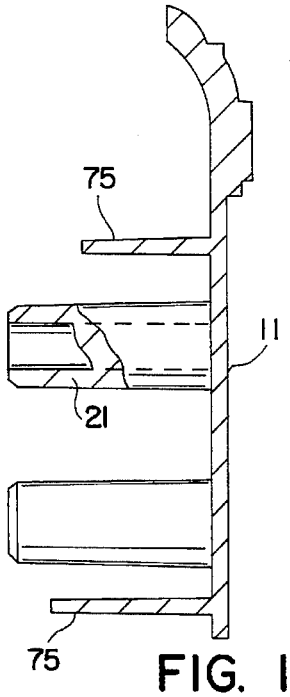
Figure 11:
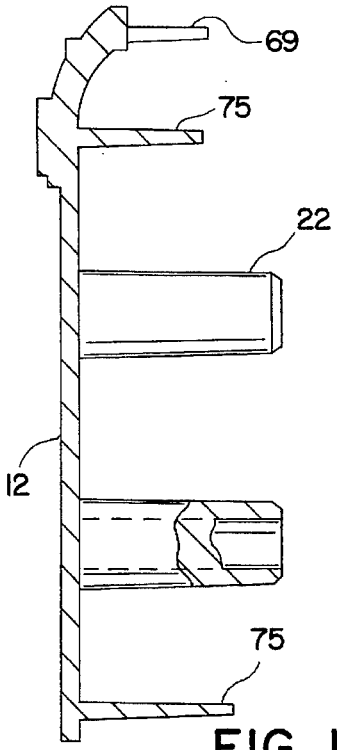

Integrally of the two halves 11, 12 optional means are provided for a mounting assembly 20. A cup 21 and plug 22 structure are employed. These are shown particularly in FIGS. 8–11 and 14. The outer mounting member and inner mounting member are essentially cylindrical in shape and molded integrally with the exterior skin of the outer half 11 and the inner half 12. A slot 24 may be used on the cup 21 to permit ease of assembly. Outer flange 30 and inner flange 31 cooperate to close the lateral edge of the door, particularly as shown in FIGS. 8 and 9. Also, as shown in FIG. 9, provision is made for a divider-rail screen and window, element 60 having a lateral edge 61 and a recess 69 defined by bridging member 62. Element 63 is an additional track so that elements 62 and 63 can respectively engage the screen and the window. This is further shown in FIGS. 13 and 14. As further shown in FIG. 20, a window latch 68 is provided at a lateral edge of the window 65, which penetrates a recess 69 and the screen 66 is secured in place by means of screen latch 70.

The window lateral edges 35, and the window top edge 36, and window bottom edge 38 of the outer half 11 are decorative desirably, whereas the inner half edges are essentially rectangular frame and larger then the outer half to allow for window and screen removal from the inside only.

A mortised lock recess 40 is provided in the outer half 11, desirably two of which are formed in opposed relationship to the other. To be noted here is that the full length hinge applied to the non-latch edge of the door covers the mortised recess which is not used. A lock 41 is then inserted, and secured in place by means of the lock seat 41.

Also an auxiliary provision is made for an automatic door closer which includes a torsion spring recess assembly 45 as shown in FIG. 17. The assembly 46 in turn includes a torsion spring 47 which terminates at one end with a foot 49 mounted against the lateral edge of the outer door half 11. This transfers through a new and innovative link mechanism 48 to the door jamb whatever kind it may be. To offset the possible severe closing action provision is made for a dampener assembly 50 which includes a dampener piston 51 secured interiorly of the tube 52. A port 54 serves to meter the compressed air and impart the dampening action. This may also be accomplished by insert molding whereas the molder may "insert," thus determining if the door closure/dampener mechanism will be inserted into the right-hand or left-hand side of the door while closing the other side.

Provision is also made for a divider rail 60 which, as disclosed in FIG. 20, provides separation for the window 65 and the screen 66. By virtue of an undercut, the divider rail insures that each slides in its own plane and one does not abrade the other.

As set forth above, in the assembly ease is provided by making the outer frame 11 the form for the door and setting it horizontally. The screen and window are ideally assembled at the end of the production line with the lock 41 and lock set 42 either secured in place or in the mortised lock recess 40, or separately packaged for installation at a later date. The torsion spring recessed assembly 46 is desirably secured at the factory prior to shipment, but means are provided for access for subsequent insertion, or replacement of the spring 46 in the event of breakage.

In summary, the molded door 10 comprises an outer half and an inner half 12. Comparable window outer opening 14 and window inner opening 12 frame the area for the window 65 and the screen 66. The outer half 11 and inner half 12 are provided with opposed torsion spring recesses 45 to the end that each door is a left-hand or right-hand door depending upon which side the spring assembly 46 is positioned. Similarly, the mortised lock recesses 40 are provided at opposed portions of the door to the end that at the factory, when the decision is made to complete the door, it can be either left-hand or right-hand. Most importantly, the two halves are molded from a sheet molded compound (SMC) which is highly stable dimensionally at various temperature extremes. The two halves of the door 11, 12 may be secured optionally together by a mounting assembly 20, or by foam 80 shaped by the dam portions 75, or a combination of both. Irrespective of which assembly means is used, the end result of an SMC door, optionally left-handed or right-handed, is economical to manufacture, and highly durable in usage.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A molded storm door with an upper edge, bottom edge, and opposed side edges having an inner half and an outer half, both halves being formed from a sheet molding compound (SMC) which has been proportioned to form an inner half and an outer half, each half having an opening for the placement of a window or a screen, characterized by:

a plurality of interlocking means extending from the front half and the rear half toward the opposite half in alignment therewith and with each other and in spaced central position between the upper edge, bottom edge and lateral edges of the door and the opening for a window, said interlocking means being proportioned to press-fittingly engage each other in essentially non-removable relationship thereto, lateral pockets opposed at a mid-portion of the door for receiving a door mortised lock set, and a lock set proportioned for fitting and securing in the pocket of the door, whereby a recessed lock set can be provided for both left-hand and right-hand mounting doors, with a door hinge on the non-lock set side of the door hiding the recess which is unused.

2. A molded door with lateral flanges forming the upper, lower, and lateral edges having an inner half and an outer half, both halves being formed from a sheet molding compound (SMC) which has been match molded to form an inner half and an outer half for the door, said door being characterized by:

dam wall means interiorly of the door in opposed relationship to exterior flanges forming the lateral top and bottom edges of the door, and means for filling the area between the inner half and the outer half defined by the dams and the lateral flanges, lateral pockets opposed at a mid-portion of the door for receiving a door mortised lock set, whereby a recessed lock set can be provided for both left-hand and right-hand mounting doors, with the hinge on the non-lock set side of the door hiding the recess for the pocket which is unused.

3. In the molded door of claim 2 above, recessed pocket means provided at opposed positions for receiving a door closer, and a door closer mechanism for insertion into one of the said pockets depending upon whether the door is a left-hand or a right-hand door, and means for coupling the door closer to the door frame, whereby the molded door has an interior concealed door closing mechanism which is optionally secured on the left-hand side or the right-hand side of the door.

4. A molded storm door with top, bottom, and lateral edges and having an inner half and an outer half, both halves being formed from a sheet molding compound (SMC) which has been proportioned to form an inner half and an outer half, each half having an opening for the placement of a window and screen interchangeable self-stored member, characterized by:

a single divider formed in one of said opposed elements defining, in combination with the other opposed element, a guide rail for receiving a screen and storm window each having a latching means, means for removably receiving the latching mechanisms from the respective storm window and screen, opposed recesses proportioned for receiving a closing assembly, and a closing assembly proportioned to fit into said opposed recesses on either the left-hand and right-hand side of the door, whereby the subject door is left-hand or right-hand depending upon where the closing assembly is located.

5. In the storm door of claim 4 above, opposed mortised recesses for receiving a lock set on the lateral edge of the door, a lock set for positioning interiorly of one of said recesses, whereby the door can be left-hand or right-hand depending upon the side in which the lock set is positioned, and wherein the lock set is recessed interiorly of the door in a traditional door receiving configuration.

6. A molded door having an inner half and an outer half, each half being formed from a sheet molding compound (SMC) which has been molded to form an inner half and an outer half, each half having top, bottom, and lateral edge flanges which overlap each other, and opposed dam forming means extending centrally from both halves of the door to define with the opposite dam means an area between the dam and the flanges, recess means on opposed lateral edges for receiving a lock set, whereby a lock set may be mounted interiorly of the door on the left-hand side or the right-hand side, and where the opposite opening for the lock set is masked by a hinge on the side opposite the lock set.

7. In the molded door of claim 6 above, recess means on opposed lateral edges for receiving a lock set, whereby a lock set may be mounted to the door on the left-hand side or the right-hand side, and where the opposite opening for the lock set is masked by a hinge on the side opposite the lock set.

8. In the molded door of claim 6 above, opposed recesses on the lateral edges of the door for receiving a closer, and a door closer mechanism for mounting interiorly of one side of the door in one of the opposed recesses, said door closer means having a coupler for engaging the door frame, whereby an interiorly hidden door closer can be provided on a door on either the left-hand or the right-hand side for closing the same.

9. A molded door having flanges defining top, bottom, and lateral edges and having an inner half and an outer half, both halves being formed from a sheet molding compound (SMC) which has been proportioned to form an inner half and an outer half for the door, said door being characterized by:

dam wall means interiorly of the door in opposed relationship to exterior flanges forming the lateral top and bottom edges of the door, and means for filling the area between the inner half and the outer half defined by the dams and the lateral flanges, lateral pockets opposed at a mid-portion of the door for receiving a door lock set, whereby a recessed lock set can be provided for both left-hand and right-hand mounting doors, whereby a hinge on the non-lock set side of the door hides the recess for the pocket which is unused.

10. In the molded door of claim 9 above, recessed closer pocket means provided at opposed positions for receiving a door closer, and a door closer mechanism for insertion into one of the said recessed closer pockets depending upon whether the door is a left-hand door or a right-hand door, and means for coupling the door closer to the door frame, whereby the molded door has an interior concealed door closing mechanism which is optionally secured on the left-hand side or the right-hand side of the door.

* * * * *